US010967629B2

(12) United States Patent
Lee

(10) Patent No.: US 10,967,629 B2
(45) Date of Patent: Apr. 6, 2021

(54) PRINTING APPARATUS CARRIAGE FOR CONTAINER HAVING CIRCULAR CROSS SECTION

(71) Applicant: Win Soon, Inc., South Gate, CA (US)

(72) Inventor: Ho Jong Lee, Seongnam-si (KR)

(73) Assignee: WIN SOON, INC., South Gate, CA (US)

( * ) Notice: Subject to any disclaimer, the term of this patent is extended or adjusted under 35 U.S.C. 154(b) by 0 days.

(21) Appl. No.: 16/601,838

(22) Filed: Oct. 15, 2019

(65) Prior Publication Data

US 2020/0223232 A1 Jul. 16, 2020

(30) Foreign Application Priority Data

Jan. 10, 2019 (KR) ..... 10-2019-0003088

(51) Int. Cl.

| | |
|---|---|
| ***B41F 17/18*** | (2006.01) |
| ***B41F 17/00*** | (2006.01) |
| ***B41F 17/22*** | (2006.01) |
| ***B65B 61/26*** | (2006.01) |
| ***B65C 9/02*** | (2006.01) |

(52) U.S. Cl.

CPC ..... *B41F 17/002* (2013.01); *B41F 17/007* (2013.01); *B41F 17/18* (2013.01); *B41F 17/22* (2013.01); *B65B 61/26* (2013.01); *B65C 9/02* (2013.01)

(58) Field of Classification Search

CPC ..... B41F 17/002; B41F 17/006; B41F 17/18; B41F 17/20; B41F 17/22; B41F 17/28; B65B 61/26; B65C 9/02; B65C 9/04; B65C 9/045

USPC ..... 101/36, 37, 38.1, 39, 40, 40.1

See application file for complete search history.

(56) References Cited

U.S. PATENT DOCUMENTS

| | | | | |
|---|---|---|---|---|
| 3,486,442 | A * | 12/1969 | Weber | B41F 17/18 101/40 |
| 4,098,183 | A * | 7/1978 | Johnson | B41F 17/22 101/40 |
| 4,572,067 | A * | 2/1986 | Fischer | B29C 59/021 101/29 |
| 5,637,182 | A | 6/1997 | Kimura et al. | |
| 5,823,106 | A | 10/1998 | No et al. | |
| 5,835,106 | A | 11/1998 | No | |

FOREIGN PATENT DOCUMENTS

| | | |
|---|---|---|
| KR | 10-0771199 | 10/2007 |

* cited by examiner

*Primary Examiner* — Leslie J Evanisko
(74) *Attorney, Agent, or Firm* — Lex IP Meister, PLLC

(57) ABSTRACT

Disclosed is a printing apparatus carriage for a container having a circular cross section. The present invention is directed to perform stable transport and mass printing therethrough without using a groove formed on a middle part of the container when the container is transported.

3 Claims, 3 Drawing Sheets

PRINTING APPARATUS CARRIAGE FOR CONTAINER HAVING CIRCULAR CROSS SECTION

CROSS-REFERENCE TO RELATED APPLICATION

This application claims priority to and the benefit of Korean Patent Application No. 2019-0003088 filed on Jan. 10, 2019, the disclosure of which is incorporated herein by reference in its entirety.

BACKGROUND

1. Field of the Invention

The present invention relates to a carriage which discharges a container, on which an ink printing layer is formed, from an apparatus which prints a variety of letters or shapes for indicating a trademark, a manufacturer, contents, ingredients, and the like of a product on an outer circumferential surface (curved surface) of a beverage container having a circular cross section, and more particularly to a printing apparatus carriage for a container having a circular cross section capable of increasing printing quality by appropriately discharging a container without damage to an ink layer during a process of drying the container.

2. Discussion of Related Art

Nowadays, packaging containers such as glass bottles and plastic bottles having a circular cross section are being used for beverages or food, and a variety of letters or shapes for indicating a trademark, a manufacturer, contents, ingredients, and the like of a product are printed on outer circumferential surfaces (curved surfaces) thereof.

A printing method is generally used of printing using a particular ink using a particular drum (etched metal plate) and heating and fusing the ink to a surface of a packaging container having a circular cross section as a method of printing a variety of letters or shapes on a curved surface of the packaging container.

That is, when an etched groove of a desired pattern formed on an outer circumferential surface of a drum is filled with ink, the ink is sent to an elastic pad and then printed while being transferred to a curved surface of a packaging container passing through a particular point through automatic supply like stamping a seal so that efficient operation and automation may be embodied.

A conventional printing apparatus for a packaging container having a circular cross section includes an ink supply portion which supplies ink to a drum with a desired pattern formed thereon, a printing portion which stamps the ink sent from the drum to an elastic pad on a packaging container and a transport portion which transports packaging containers in a row.

Here, the transport portion separately supports a packaging container and prevent a shift in position caused by a pressure of the printing portion which is applied to a perimeter thereof while printing.

However, in the conventional printing apparatus for a packaging container, since a phenomenon occurs in which a curved surface of a packaging container is not pressed against a surface of an elastic pad and is spaced apart therefrom when the printing portion applies a pressure for stamping, printing quality considerably decreases and a defective rate of damaging an ink printing layer of the packaging container is very high.

Also, in an existing process of printing a container with a groove on a middle part, printing is performed using a method of moving a bottle using a groove formed on the middle part of the container.

In the above case, since a container is moved using the groove, it is necessary to use only a container having a groove on a middle part thereof even in a mass printing apparatus.

Here, the above-described related art or conventional technology is information possessed by the inventor or obtained during a process of deriving the present invention and is merely helpful in understanding the technical meaning of the present invention but does not signify a well-known art in the technical field of the present invention. In addition, reference numerals in the conventional technology are irrelevant to reference numerals in the present invention.

RELATED ART DOCUMENT

Patent Document

Korean Patent Registration No. 10-0311534 B1 (Sep. 26, 2001)

Korean Patent Registration No. 10-0398273 B1 (Sep. 2, 2003)

Korean Patent Registration No. 10-0771199 B1 (Oct. 23, 2007)

SUMMARY OF THE INVENTION

The present invention is directed to provide a printing apparatus carriage for a container having a circular cross section, which has a new structure capable of adequately stamping ink in a particular pattern on an outer circumferential surface (curved surface) of a packaging container and adequately discharging an ink printing layer without damage so as to increase printing quality.

The present invention is directed to perform stable transport and mass printing therethrough without using a groove formed on a middle part of the container when the container is transported.

The present invention is directed to provide a printing apparatus carriage for a packaging container having a circular cross section, in which a container is moved while a bottom of the container is guided and an inclined curved surface of an upper part is supported using tension of a belt to move simultaneously with printing of a stamping roll so as to develop a container and a printing apparatus capable of performing mass printing to choose a variety of shapes with no need to form a groove on an exterior of the container.

It should be noted that objects of the present disclosure are not limited to the above-described objects, and other objects of the present disclosure will be apparent to those skilled in the art from the following descriptions.

According to one aspect of the present invention, there is provided a printing apparatus carriage that is applied to a printing apparatus installed on a transport portion transporting containers having circular cross sections aligned in a row and configured to form an ink-printing layer on a lower outer circumferential surface (curved surface) of each of the containers inserted at certain intervals by a timing screw from the transport portion while a stamping roll rolls and stamps ink in a pattern groove formed on an outer circumferential surface of a drum on an outer circumferential surface (curved surface) of the container. The printing apparatus carriage includes a guide installed to face the stamping roll and operating to support the container not to be pushed while the stamping roll stamps ink on the lower outer circumferential surface (curved surface) of the container, first and second guardrails arranged in parallel with a certain interval therebetween to guide the container moving as a reaction to rotation of the stamping roll and to prevent derailment, and a drive which drives and circulates a belt, which is pressed against an upper outer circumferential surface (curved surface) of the container in front of the first guardrail and placed over a belt pulley and a plurality of idle pulleys while maintaining uniform tension, using a rotational driving force of an electric motor to transport the container along the first and second guardrails.

Printing quality of the container may be significantly increased by adequately stamping ink in a particular pattern on an outer circumferential surface (curved surface) of the container and may be adequately discharged without damage to an ink printing layer.

The printing apparatus carriage may further include a guide rail which guides movement of the container entering as the reaction to the rotation of the stamping roll and supports a bottom end of the container to prevent derailment such that the container may be more stably transported.

The guide may have a surface facing the stamping roll which is formed as a curved surface corresponding to a circular arc of the stamping roll and is installed to be adjustable in an installation interval from the stamping roll such that ink may be more adequately stamped on an outer circumferential surface (curved surface) but also the printing apparatus carriage may be universally used regardless of a size of the container.

The first guardrail and the drive may be provided with an interval-adjusting opening for adjusting and setting an interval from the second guardrail according to the size of the container using a screw tightening method such that the printing apparatus carriage may be universally used regardless of the size of the container.

The interval-adjusting opening may include a bracket configured to install the first guardrail and the drive at certain heights and including a plurality of slots to adjust installation positions of the first guardrail and the drive and a tightening opening which moves the first guardrail and the drive along a longitudinal direction of the slots and fixes the first guardrail and the drive to the bracket while an interval from the second guardrail is adjusted such that an installation interval between the second guardrail and the first guardrail or the drive may be quickly and easily adjusted according to the size of the container.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, an embodiment according to the present invention will be described in detail with reference to the attached drawings. Here, a detailed description of well-known functions or components of the related art will be omitted when it is deemed to obscure the essence of the present invention.

Also, for convenience and clarity of description and understanding of components and operations, a part may be exaggerated or simplified throughout the attached drawings and is not precisely equal to an actual size and shape of each component. In addition, when it is stated that one part includes one component, unless particularly described otherwise, the one part may further include another component instead of excluding another component.

Figure 1:
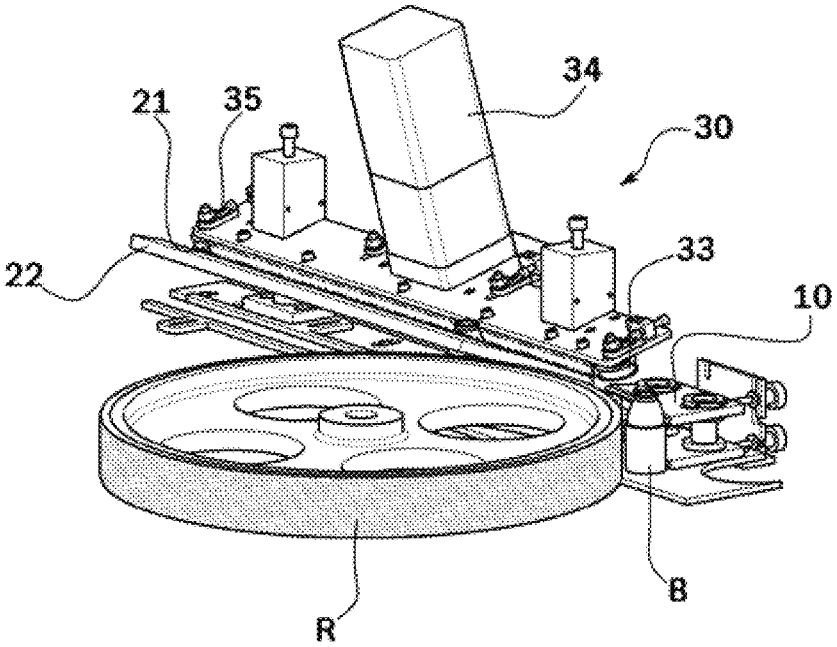
FIG. 1 is a perspective view of a printing apparatus for a container having a circular cross section according to an embodiment of the present invention.
Figure 2:
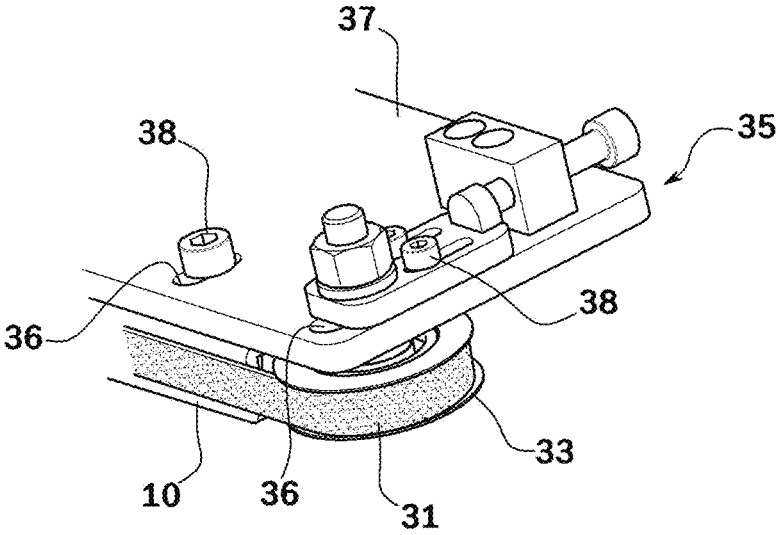
FIG. 2 is a perspective view illustrating a local part of the printing apparatus for a container having a circular cross section according to the embodiment of the present invention.
Figure 3:
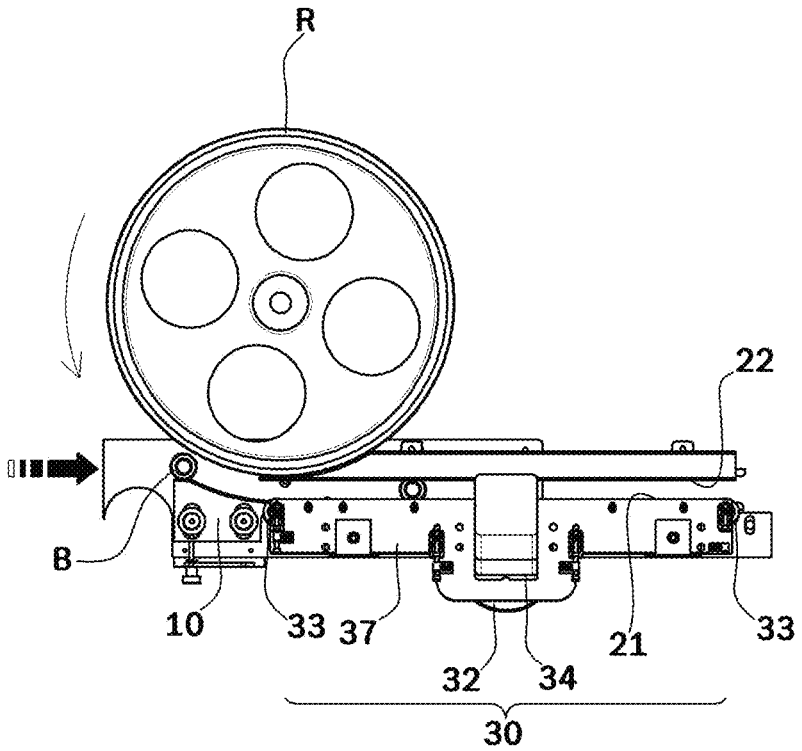
FIG. 3 is a plan view of the printing apparatus for a container having a circular cross section according to the embodiment of the present invention.
Figure 4:
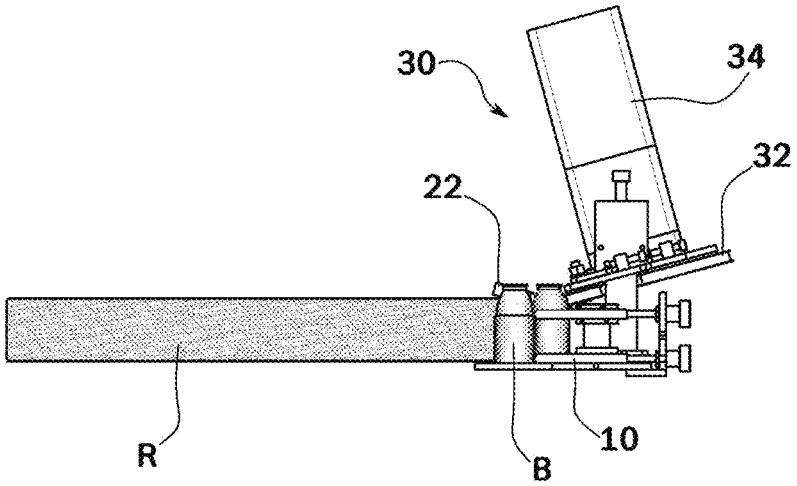
FIG. 4 is a side view of the printing apparatus for a container having a circular cross section according to the embodiment of the present invention.
Figure 5:
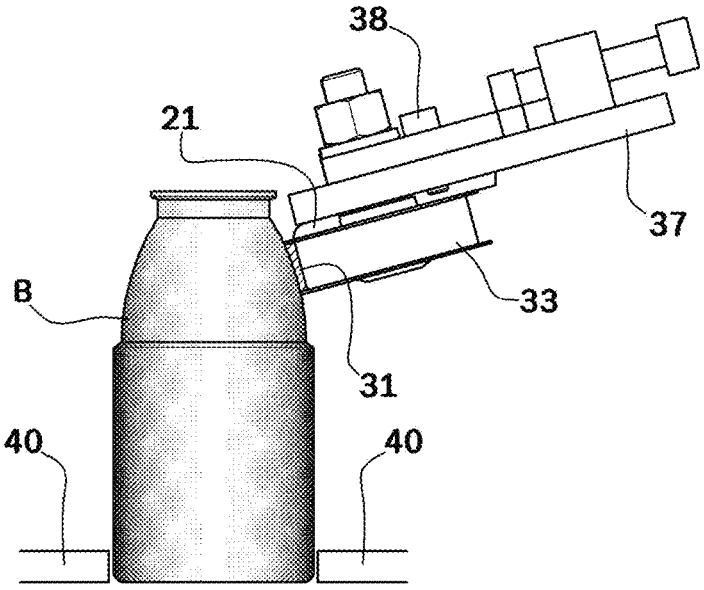
FIG. 5 is a side view illustrating a local part of the printing apparatus for a container having a circular cross section according to an embodiment of the present invention.
Figure 6:
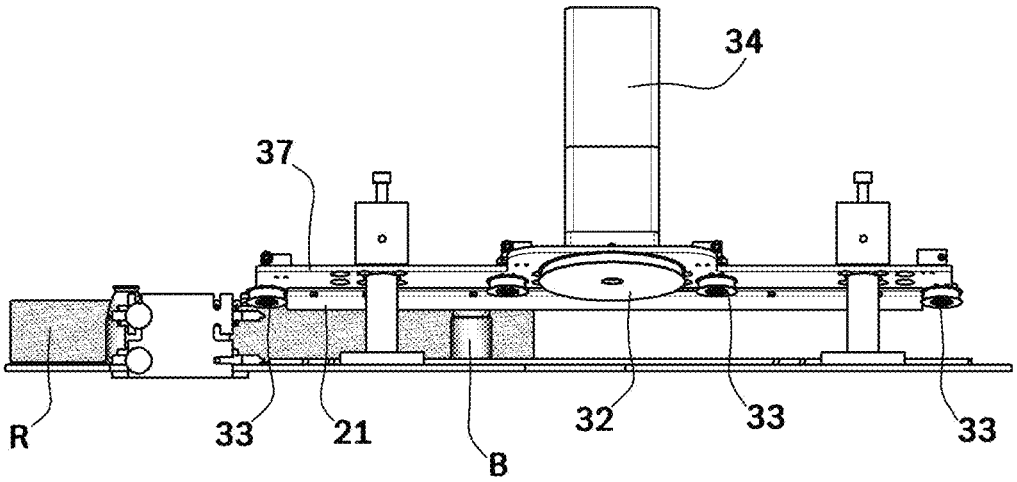
FIG. 6 is a rear view of the printing apparatus for a container having a circular cross section according to the embodiment of the present invention.

Referring to FIGS. 1 to 6, a printing apparatus carriage for a container having a circular cross section according to one embodiment of the present invention is a part which transports and discharges a container B, on which an ink-printing layer is formed, from a printing apparatus installed on a transport portion configured to transport each of containers B having a circular cross section and aligned in a row and configured to form the ink-printing layer on a lower outer circumferential surface (curved surface) of the container B inserted at certain intervals by a timing screw at the transport portion while a stamping roll R stamps ink in a pattern groove formed on an outer circumferential surface of a drum by being rotated, on an outer circumferential surface (curved surface) of the container B. The printing apparatus carriage includes a guide 10, a first guardrail 21, a second guardrail 22, a drive 30, and a guide rail 40.

Here, the transport portion may employ a conveyer structure which receives power necessary for conveying the container B from an electric motor and circulates a belt to perform continuous track movement.

The guide 10 is installed to face a part of the stamping roll R and operates to allow the container B to maintain not being pushed away while the stamping roll R stamps ink on the lower circumferential surface (curved surface) of the container B such that the ink is easily transferred to the container B.

Also, a surface of the guide 10, which faces the stamping roll R, is formed as a curved surface corresponding to a circular arc of the stamping roll R such that the container B naturally comes into close contact with the stamping roll R and easily moves simultaneously with stamping of the stamping roll R.

Also, the guide 10 is installed to be adjustable in an installation interval from the stamping roll R to be universally used regardless of a size of the container B.

The first guardrail 21 guides the container B entering as a reaction to rotation of the stamping roll R, prevents derailment thereof, and is arranged to be parallel to the second guardrail 22 with a certain interval therebetween to easily transport the container B.

Also, the first guardrail 21 includes an interval-adjusting opening 35 to adjust and set an interval from the second guardrail 22 according to the size of the container B using a screw-tightening method.

That is, the interval-adjusting opening 35 includes a bracket 37 which installs the first guardrail 21 at a certain height for universal use regardless of the size of the container B. In the bracket 37, a plurality of slots 36 adjusting an installation position of the first guardrail 21 are formed. A tightening opening 38, which moves the first guardrail 21 along a longitudinal direction of the slots 36 and fixes the first guardrail 21 to the bracket 37 using a screw-tightening method while adjusting an interval from the second guardrail 22, is provided.

The second guardrail 22 guides the container B entering as a reaction to rotation of the stamping roll R, prevents derailment thereof, and is arranged to be parallel to the first guardrail 21 with a certain interval therebetween to easily transport the container B.

That is, the second guardrail 22 is fixed to be parallel to the first guardrail 21 to guide movement of the container B.

The drive 30 is for transporting the container B along the first and second guardrails 21 and 22 and has a structure in which a belt 31 in pressed against an upper outer circumferential surface (curved surface) in front of the first guardrail 21 is placed over a belt pulley 32 and a plurality of idle pulleys 33 to be driven to perform circulation movement using a rotational driving force of the electric motor 34 while maintaining uniform tension.

Also, the drive 30 includes an interval-adjusting opening 35 to adjust and set an interval from the second guardrail 22 according to the size of the container B using a screw-tightening method.

That is, the interval-adjusting opening 35 includes the bracket 37 which installs the drive 30 at a certain height for universal use regardless of the size of the container B. In the bracket 37, the plurality of slots 36 adjusting an installation position of the drive 30 are formed. The tightening opening 38 is provided that moves the drive 30 along a longitudinal direction of the slots 36 and fixes the drive 30 to the bracket 37 using a screw-tightening method while adjusting an interval from the second guardrail 22.

Here, the drive 30 may employ a structure in which an endless belt 31 is placed over the belt pulley 32 and the idle pulleys 33 and is driven using the electric motor 34 to perform continuous track movement.

The guide rail 40 is configured to guide movement of the container B entering as a reaction to rotation of the stamping roll R and to prevent derailment thereof by supporting a bottom end of the container B.

That is, the guide rail 40 is configured to perform a function of guiding movement of the container B entering as the reaction to rotation of the stamping roll R and preventing derailment thereof by supporting the bottom end of the container B.

In the printing apparatus carriage for a container having a circular cross section according to the embodiment which is configured as described above, while the stamping roll R stamps ink on the lower outer circumferential surface (curved surface) of the container B, the guide 10 guides the container B to easily move while supporting the container B to not be pushed, and thus it is possible to adequately stamp the ink in a particular pattern on the outer circumferential surface (curved surface) of the container B.

In addition, the belt 31 of the drive 30 is pressed against a top of the container B while pressing the same so as to more easily and stably discharge the container B by preventing a slipping phenomenon, in which the belt 31 runs idle or slips such that the container B is not pulled or pushed.

In addition, the belt 31 obliquely tilts toward the upper outer circumferential surface (curved surface) of the container B, on which an ink-printing layer is not formed, and comes into stable contact with the container B such that the container B may be more naturally discharged. Accordingly, printing quality may be significantly improved by maintaining a favorable state without damage to the ink-printing layer of the container B caused by an external contact or the like before the ink-printing layer is dried.

In addition, heights and locations of the first guardrail 21 and the drive 30 with respect to the bracket 37 may be adjusted and set according to the size of the container B using a screw tightening method such that the apparatus may be universally used regardless of a variety of sizes of the containers B.

According to the embodiments of the present invention, since a guide supports and rotates a container not to be pushed and to easily move while being pressed against the stamping roll when a stamping roll stamps ink on a lower outer circumferential surface (curved surface) of the container, the ink may be adequately stamped (printed) in a particular pattern on an outer circumferential surface (curved surface) of the container.

Since the container rotates and moves due to a frictional force of a belt naturally coming into contact with an upper circumferential surface (curved surface) of the container and circularly moving due to a driving force of the drive, an ink printing layer may be transported and dried with no contact during a process of transferring and drying the container.

Accordingly, the ink printing layer may remain in an adequate state without being damaged by an external contact or the like before the ink printing layer is dried such that printing quality of the container may be significantly increased. Also, safe transport and mass printing therethrough may be available without using a groove formed on a middle part of the container while the container is transported.

In addition, since it is possible to easily adjust an interval between the second guardrail and the first guardrail or the drive, the printing apparatus carriage may be universally used regardless of the size of the container.

Effects of the present disclosure will not be limited to the above-mentioned effects and other unmentioned effects will be clearly understood by those skilled in the art from the following claims.

Meanwhile, it is apparent to one of ordinary skill in the art that the present invention is not limited to the above-described embodiment and the attached drawings and a variety of modifications and applications may be made therein without departing from the technical concept of the present invention and components may be substituted by and changed into other equivalent embodiments to be widely applied.

Therefore, it should be noted that the content related to changes and applications of the technical features of the present invention are included in the technical concept and scope of the present invention.

What is claimed is:

1. A printing apparatus carriage for a container having a circular cross section, which is applied to a printing apparatus installed on a transport portion transporting containers having circular cross sections aligned in a row and configured to form an ink-printing layer on a lower outer circumferential curved surface of each of the containers inserted at certain intervals by a timing screw from the transport portion while a stamping roll rolls and stamps ink in a pattern groove formed on an outer circumferential surface of a drum on an outer circumferential curved surface of the container, the printing apparatus carriage comprising:

a guide installed to face the stamping roll and configured to operate to support the container not to be pushed while the stamping roll stamps ink on the lower outer circumferential curved surface of the container;

a first guardrail and a second guardrail arranged in parallel with a certain interval therebetween to guide the container entering as a reaction to rotation of the stamping roll and to prevent derailment;

a drive which drives and circulates a belt, which is pressed against an upper outer circumferential curved surface of the container in front of the first guardrail and placed over a belt pulley and a plurality of idle pulleys while maintaining uniform tension, using a rotational driving force of an electric motor to transport the container along the first and second guardrails; and a guide rail which guides movement of the container entering as the reaction to the rotation of the stamping roll and supports a bottom end of the container to prevent derailment, wherein the guide has a surface facing the stamping roll which is formed as a curved surface corresponding to a circular arc of the stamping roll and is installed to be adjustable in an installation interval from the stamping roll.

2. The printing apparatus carriage according to claim 1, wherein the first guardrail and the drive are provided with an interval-adjusting opening configured to adjust and set an interval from the second guardrail according to a size of the container using a screw tightening method.

3. The printing apparatus carriage of claim 2, wherein the interval-adjusting opening comprises:

a bracket configured to install the first guardrail and the drive at certain heights and comprising a plurality of slots to adjust installation positions of the first guardrail and the drive; and a tightening opening which moves the first guardrail and the drive along a longitudinal direction of the slots and fixes the first guardrail and the drive to the bracket while an interval from the second guardrail is adjusted.

* * * * *